US006488595B1

(12) United States Patent
Grace

(10) Patent No.: US 6,488,595 B1
(45) Date of Patent: Dec. 3, 2002

(54) PUTTER HAVING EXTRA HIGH MOMENT OF INERTIA

(76) Inventor: Robert M. Grace, 2730 Bullard Dr., Clearwater, FL (US) 33762

( * ) Notice: Subject to any disclaimer, the term of this patent is extended or adjusted under 35 U.S.C. 154(b) by 0 days.

(21) Appl. No.: 09/681,848

(22) Filed: Jun. 15, 2001

(51) Int. Cl.[7] ..... A63B 53/04; A63B 53/06; A63B 53/08

(52) U.S. Cl. ..... 473/341; 473/349; 473/313; 473/292

(58) Field of Search ..... 473/313, 314, 473/340, 341, 342, 344, 345, 349, 350, 292, 293, 294, 251

(56) References Cited

U.S. PATENT DOCUMENTS 4,693,478 A * 9/1987 Long ..... 273/164
5,078,398 A * 1/1992 Reed et al. ..... 273/80 A
5,580,058 A * 12/1996 Coughlin ..... 273/250

* cited by examiner

*Primary Examiner*—Steven Wong
*Assistant Examiner*—Sneh Varma
(74) *Attorney, Agent, or Firm*—Ronald E. Smith; Smith & Hopen, P.A.

(57) ABSTRACT

10A golf putter having a moment of inertia in the 12,000–28,000 gm/cm$^2$range. The main body of a putter blade is disposed in trailing relation to a ballstriking surface and includes a frame part formed of a preselected light-in-weight material. The frame part has enlarged openings at its toe and heel ends for receiving toe and heel weight members. The toe and heel weight members are formed of a preselected material heavier than the material that forms the frame part. One embodiment has a length of about seven and one-half inches, a weight of about five hundred fifty grams, and a moment of inertia of about 28,000 gm/cm$^2$.

12 Claims, 3 Drawing Sheets

FIG. 1
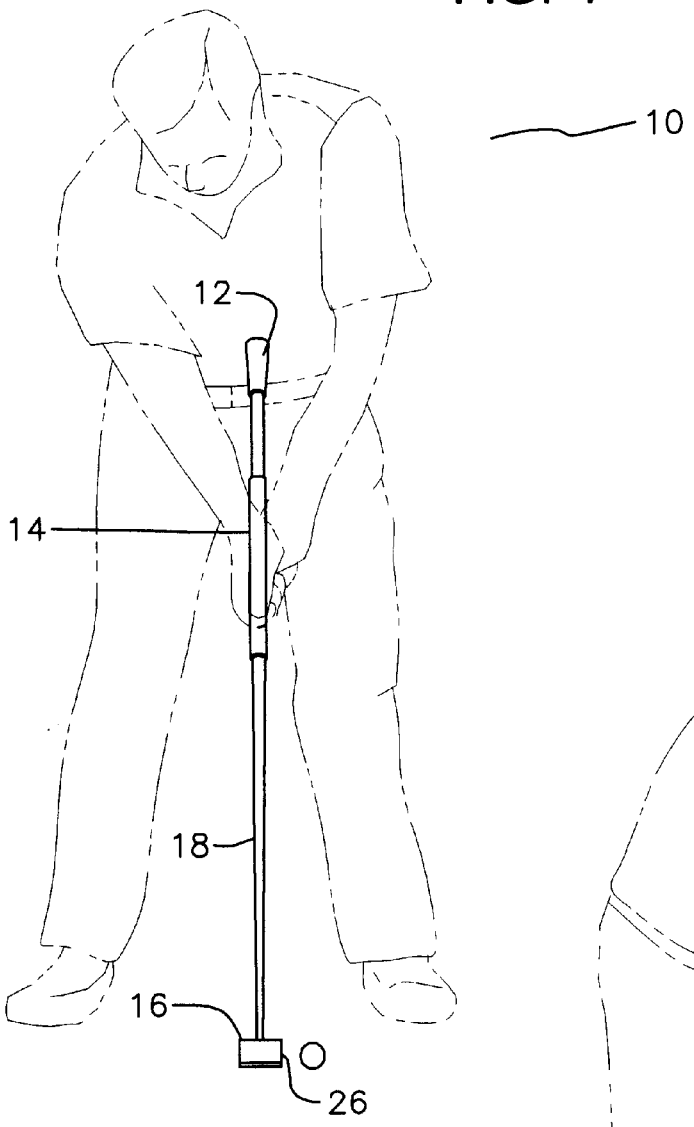
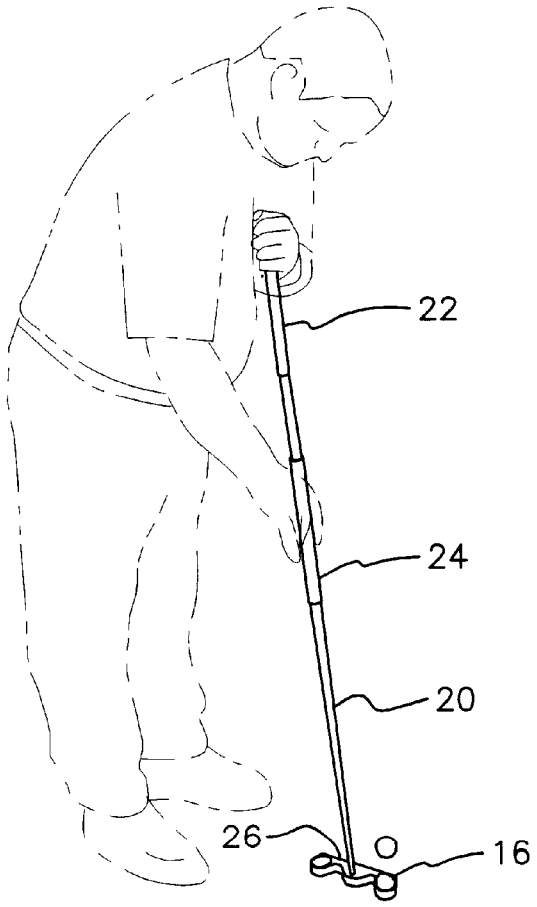
FIG. 2

PUTTER HAVING EXTRA HIGH MOMENT OF INERTIA

BACKGROUND OF INVENTION

1. Field of the Invention

This invention relates, generally, to putters. More particularly, it relates to a putter characterized by an extraordinarily high moment of inertia.

2. Description of the Prior Art

Newton's first law of motion states that an object in motion along a path of travel will continue to move along that path of travel unless an external force acts against it and that an object at rest remains at rest unless an external force acts against it. Inertia is the property of the object that resists a change in its motion or its state or rest.

Most golfers and even many golf putter manufacturers are unaware of the importance of inertia to the putting game. A putter has a low moment of inertia if a putt that misses the sweet spot causes rotation of the putter blade about the longitudinal axis of the golf club shaft, resulting in a putt that veers away from the intended path of travel. Such putter blades are typically light-in-weight (typically between 305 to 350 grams), made of a single material, and have a short heel-to-toe distance measurement. However, a putter blade can also have a low moment of inertia even if it is relatively heavy and has a relatively long toe-to-heel measurement.

Some inventors have noticed that the moment of inertia of a putter may be increased by adding weights to the outermost ends of the putter blade, ie., to the toe and heel of said blade. When a golfer misses the sweet spot when using one of these weighted putters, the putter is relatively forgiving in that the putt does not veer from the target as much as if a low inertia putter had been used.

One putter manufacturer claims in a website that its putters have a moment of inertia of about 9,000. Although such a putter provides a much higher moment of inertia than a conventional putter, it is still insufficient to provide a truly forgiving putter.

What is needed is a putter that provides a moment of inertia in the range of 12,000 to 28,000 grams per square centimeter ($g/cm^2$). Such a putter would enable a golfer to strike the ball near or at the toe or heel of the putter with littler no loss of accuracy in the shot, i.e., every spot on such a putter would provide a sweet spot.

One possible approach would be to make a putter blade having a very long heel to toe distance measurement, and to attach very heavy weights to its outermost ends. Such a putter, however, would be impractical to use and unattractive to consumers. Moreover, the U.S. Golf Association (USGA) would not approve such a putter for tournament play. The challenge is to provide a putter having a super high moment of inertia that maintains its attractiveness and practicality and that is approved by the USGA for tournament play.

However, in view of the prior art considered as a whole at the time the present invention was made, it was not obvious to those of ordinary skill in the pertinent art how such a putter could be provided.

SUMMARY OF INVENTION

The longstanding but heretofore unfulfilled need for a putter having an extraordinarily high moment of inertia is now met by a new, useful, and nonobvious invention. The novel putter includes a putter blade having a substantially flat ball-striking surface and a main body disposed in trailing relation to the ball-striking surface. The main body has a first part formed of a first preselected material and a second part formed of a second preselected material.

The first part includes a central base having a blind bore formed therein. The blind bore is adapted to receive a golf club shaft. The first part further includes a first weight-holding means formed in a toe end thereof and a second weight-holding means formed in a heel end thereof.

The second part includes a first weight means that is securely mounted within the first weight-holding means and a second weight means that is securely mounted within the second weight-holding means. The first and second weight means are formed of the second preselected material and have a common preselected weight.

The second preselected material has a greater weight than the first preselected material. Accordingly, the putter has a moment of inertia that inhibits rotation of the putter blade about a longitudinal axis of the golf club shaft when the ball-striking surface strikes a golf ball, even if the point of impact is remote from the sweet spot of the putter blade.

The novel putter further includes a first interconnecting member disposed between the first weight-holding means and the center base and a second interconnecting member disposed between the second weight-holding means and the center base. The first interconnecting member and the second interconnecting member have a common depth. The first weight holding means and the second weight holding means have a common depth greater the common depth of the first and second interconnecting members. The center base has a depth greater than the common depth of the first and second interconnecting members but less than the common depth of the first and second weight holding members.

In a preferred embodiment, the first preselected material is aluminum and the second preselected material is copper. In another embodiment, the first preselected material is a high impact plastic and the second preselected material is titanium. Any other suitable materials may be used in any combination as the first and second materials, subject to the requirement that the weight of the second material must exceed the weight of the first.

The primary object of the invention is to provide a golf putter having a heretofore unobtainable moment of inertia in the range of 12,000–28,000 $gm/cm^2$.

A closely related object is to attain the foregoing object with a putter that is attractive in appearance so that it will meet with consumer acceptance.

Another object is to attain the primary object with a putter that is approved by the USGA.

A more specific object is to advance the art of putters by providing a putter having a base formed of a relatively low density, low weight material and having mounting means at its outermost ends for holding a high density, heavy weight material.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF DRAWINGS

For a fuller understanding of the nature and objects of the invention, reference should be made to the following detailed description, taken in connection with the accompanying drawings, in which:

FIG. 1 is a perspective view of a golfer using a belly putter equipped with the novel putter blade of this invention;

FIG. 2 is a perspective view of a golfer using a long putter equipped with said novel putter blade;

DETAILED DESCRIPTION

Figure 3:
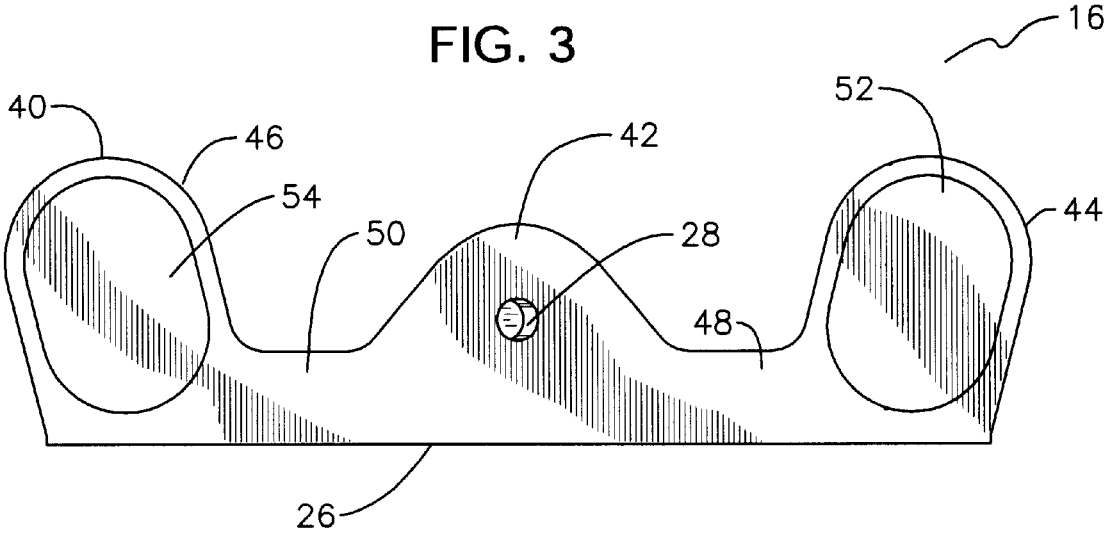
FIG. 3 is a top plan view of the novel putter blade.

Referring to FIG. 1, it will there be seen that the reference numeral 10 denotes an illustrative embodiment of the novel putter when provided in the form of a belly putter. A belly putter is usually about 39 to 46 inches in length, ie., a few inches longer than a conventional putter. The proximal end of first club handle 12 is pressed into the stomach of a golfer and the golfer grips second club handle 14 in the manner shown. Novel putter blade 16 is secured to the distal free end of elongate shaft 18. This well-known putting stance steadies the hands of the golfer during a putt, i.e., it reduces the "yips" that many golfers experience from time to time when putting.

FIG. 2 depicts the same novel putter blade 16, but shaft 20 of this embodiment is a long shaft. A long putter is usually about 46 to 54 inches in length. The golfer grips the proximal end of first handle 22 with the non-dominant hand and controls second handle 24 with the dominant hand. The non-dominant hand is pressed against the chest during the swing. This type of swing also helps overcome the yips.

Although novel putter blade 16 has been introduced in connection with a belly putter and a long putter, it should be understood that the novel putter blade also has utility in connection with putters having shafts of conventional length. However, since an important object of the invention is to provide a putter blade having an exceptionally high moment of inertia that will meet with consumer acceptance, it is believed that the relatively lengthy heel-to-toe measurement of the novel putter blade renders said blade more suitable for use with belly and long putters.

In a preferred embodiment, ball-striking surface 26 is about six and one-half inches (6½") in length, has a weight of about five hundred grams (500 gm), and a moment of inertia of about 17,000 gm/cm$^2$. However, this invention contemplates putter blades in the range of about five and one-half inches (5½") to about seven and one-half inches (7½") in length and from about four hundred fifty grams to five hundred fifty grams (450–550 gm). Putters of such characteristics have moments of inertia in the range of 12,000 to 28,000 gm/cm$^2$. The preferred embodiment of this invention has been approved by the USGA and approval of the larger and heavier putters is expected upon application for approval thereof. Significantly, the highly pleasing yet functional design disclosed herein, together with use of the putter blades in connection with belly and long putters, ensures that golfers, as well as the USGA, will readily accept the putters of this invention whereas a conventional putter blade merely made long and heavy to achieve a high moment of inertia would not be so accepted.

Figure 4:
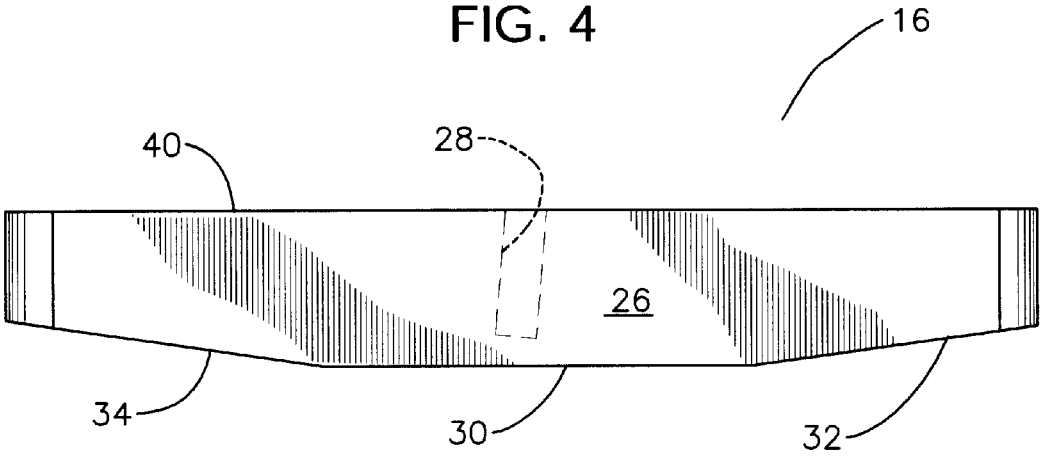
FIG. 4 is a front elevational view thereof.
Figure 5:
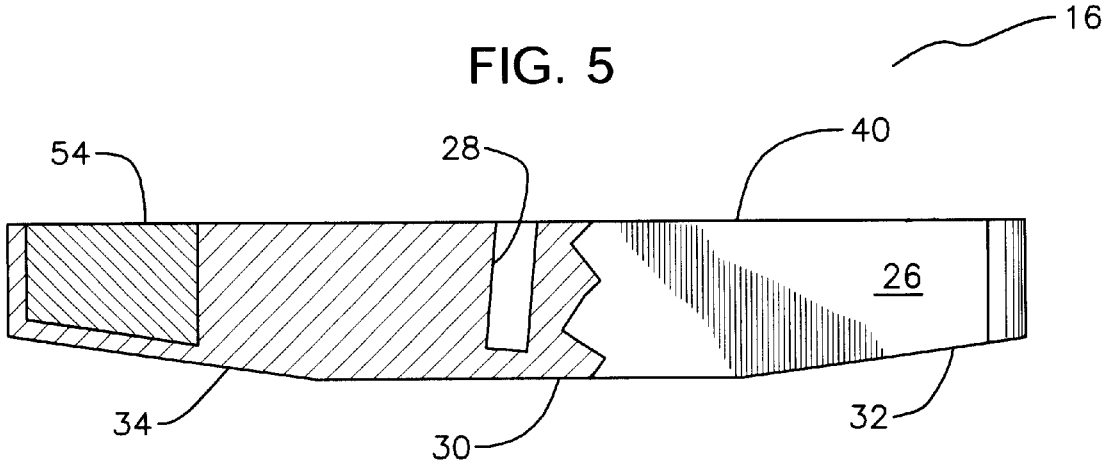
FIG. 5 is a partially sectional front elevational view thereof.
Figure 6:
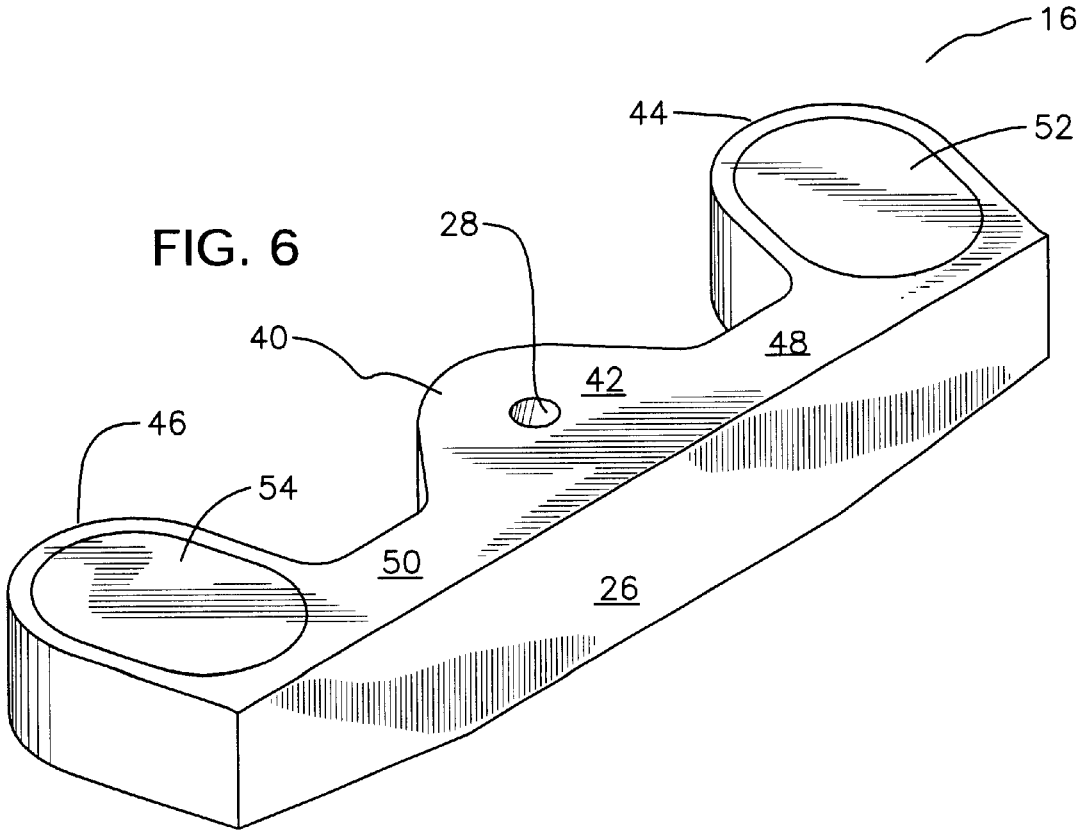
FIG. 6 is a perspective view thereof.

As indicated in FIGS. 3–6, blind bore 28 is formed in putter blade 16 at or near the center of gravity of said putter blade and is adapted to receive shaft 18 or 20 of a belly or long putter, respectively, as well as the shaft of a conventional putter. The longitudinal axis of symmetry of bore 28 is positioned at a predetermined angle relative to a vertical plane so that sole 30 (FIGS. 4 and 5) is substantially parallel to the ground at the moment of ball impact when the golfer holds the club properly as depicted in FIGS. 1 and 2. A heel section 32 of the sole and a toe section 34 thereof are disposed at a small angle relative to sole 30.

Main body or frame 40 of putter blade 16 has a highly novel structure and is made of a first preselected light-in-weight material such as aluminum or plastic. Main body 40 extends in trailing relation to ball-striking surface 26 and has the same vertical ex:tent as said surface 26. Main body 40 includes. a central base 42 having bore 28 formed therein, a pair of large weight-retaining members 44, 46 at the outermost ends of main body 40, and a pair of interconnecting members 48, 50 that extend in interconnecting relation between central base 42 and said weight retaining members 44, 46. The depth of interconnecting members 48, 50 is substantially less than the depth of weight retaining members 44,46. The depth of central base 42 is greater than the depth of interconnecting members 48, 50 but less than that of said weight-retaining members.

Weight-retaining members 44, 46 are open-topped blind bores adapted to receive therewithin first and second weight members 52, 54, respectively. Weight member 52, 54 are formed of a second preselected material such as copper, titanium, or other heavy material. Although many differing materials may be employed, the weight of the second preselected material should exceed that of the first preselected material. The use of copper is preferred since it is less expensive than titanium. Moreover, copper weights are very pleasing to the eye when set in an aluminum frame or plastic shell such as main body 40. Ball-striking surface 26 may also be anodized to present a black surface when aluminum is used, further enhancing the aesthetic appearance of the novel putter.

Weight-retaining members 44, 46 are open-topped blind bores adapted to receive therewithin first and second weight members 52, 54, respectively. Weight member 52, 54 are formed of a second preselected material such as copper, titanium, or other heavy material. Although many differing materials may be employed, the weight of the second preselected material should exceed that of the first preselected material. The use of copper is preferred since it is less expensive than titanium. Moreover, copper weights are very pleasing to the eye when set in an aluminum frame or plastic shell such as main body 40. Ball-striking surface 26 may also be anodized to present a black surface when aluminum is used, further enhancing the aesthetic appearance of the novel putter.

Weight-retaining members 44, 46 are also angled to form an obtuse angle with ball-striking surface 26 to position weights 52, 54 further from the center of the putter blade. This further enhances the moment of inertia of the novel putter blade.

It will thus be seen that the objects set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A putter, comprising:

a putter blade including a flat ball-striking surface and a main body disposed in trailing relation to said ball-sling surface;

said main body having a first part formed of a first material and a second part formed of a second material;

said first part including a central base having a blind bore formed therein, said blind bore adapted to receive a golf club shaft;

said first part further including a first weight-holding means formed in a toe end thereof and a second weight-holding means formed in a heel end thereof;

said first weight-holding means being provided in the form of an open-topped blind bore formed in said toe end of said first part;

said second weight-holding means being provided in the form of open-topped blind bore formed in said heel end of said first part;

said second part including a first weight means that is securely mounted within said first weight-holding means and a second weight means that is securely mounted within said second weight-holding means;

said first and second weight means being formed of said second material and having a common weight;

said second material having a greater weight than said first material;

a first interconnecting member disposed between said first weight-holding means and said central base;

a second interconnecting member disposed between said second weight-holding means and said central base;

said first interconnecting member and said second interconnecting member having a common depth and being formed integrally with said central base and said first and second weight-holding means, respectively, said first weight holding means and said second weight holding means having a common depth greater than said common depth of said first and second interconnecting members;

said central base having a depth greater than the common depth of said first and second interconnected members;

said central base having a depth less than said common depth of said first and second weight holding means;

said blind bore formed in said central base being positioned mid-depth of said central base in trailing relation to a leading end of said first and second weight members and in leading relation to a trailing end of said first and second weight members;

whereby a mechanical advantage is obtained by said positioning of said blind bore relative to said weight holding means because a leading end of said first and second weight means is disposed in leading relation to said blind bore and hence to said golf club shaft.

2. The putter of claim 1, wherein said first material is aluminum.

3. The putter of claim 1, wherein said first material is a plastic.

4. The putter of claim 1, wherein said second material is copper.

5. The putter of claim 1, wherein said second material is titanium.

6. The putter of claim 1, wherein each of said first and second weight-holding means are positioned to form an obtuse angle with said ball-striking surface to position said weight means further from the center of the putter blade and to further increase the moment of inertia of the putter blade.

7. A putter, comprising:

a putter blade including a flat ball-striking surface and a main body disposed in trailing rotation to said ball-striking surface;

said putter blade having a length of about five and one-half inches to seven and one-half inches and a weight between about four hundred fifty grams and five hundred fifty grams;

said main body having a first part formed of a first preselected material and a second part formed of a second preselected material;

said first part including a central base having a blind bore formed therein, said blind bore adapted to receive a golf club shaft;

said first part further including a first weight-holding means formed in a toe end thereof and a second weight-holding means formed in a heel end thereof, said first weight-holding means being provided in the form of an open-topped blind bore formed in said toe end of said first part;

said second weight-holding means being provided in the form of an open-topped blind bore formed in said heel end of said first part;

said second part including a first weight means that is securely mounted within said first weight-holding means and a second weight means that is securely mounted within said second weight-holding means;

said first and second weight means being formed of said second preselected material and having a common preselected weight;

said second preselected material having a greater weight than said first preselected material;

a first interconnecting member disposed between said first weight-holding means and said central base;

a second interconnecting member disposed between said second weight-holding means and said central base;

said first interconnecting member and said second interconnecting member having a common depth and being formed integrally with said central base and said first and second weight-holding means, respectively;

said first weight holding means and said second weight holding means having a common depth greater than said common depth of said first and second interconnecting members;

said central base having a depth greater than the common depth of said first and second interconnecting members;

said central base, having a depth less than said common depth of said first and second weight holding members;

said blind bore formed in said central base being positioned mid-depth of said central base in trailing relation to a leading end of said first and second weight members and in leading relation to a trailing end of said first and second weight members;

whereby a mechanical advantage is obtained by said positioning of said blind bore relative to said weight holding means because a leading end of said first and second weight means is disposed leading relation to said blind bore and hence to said golf club shaft.

8. The putter of claim 7, wherein said first material is aluminum.

9. The putter of claim 7, wherein said first material is a plastic.

10. The putter of claim 7, wherein said second material is copper.

11. The putter of claim 7, wherein said second material is titanium.

12. The putter of claim 7, wherein each of said first and second weight-holding means are positioned to form an obtuse angle with said ball-striking surface to position said weight means further from the center of the putter blade and to further increase the moment of inertia of the putter blade.

* * * * *